US006304184B1

(12) United States Patent
Kolton et al.

(10) Patent No.: US 6,304,184 B1
(45) Date of Patent: Oct. 16, 2001

(54) ARTICLE IDENTIFICATION AND SURVEILLANCE TAG

(75) Inventors: Chester Kolton, Westfield; Michael Norman, East Brunswick, both of NJ (US)

(73) Assignee: B&G Plastics, Inc., Newark, NJ (US)

( * ) Notice: Subject to any disclaimer, the term of this patent is extended or adjusted under 35 U.S.C. 154(b) by 0 days.

(21) Appl. No.: 09/466,112

(22) Filed: Dec. 17, 1999

(51) Int. Cl.[7] ..... G08B 13/14

(52) U.S. Cl. ..... 340/572.8; 340/572.1; 340/568.1

(58) Field of Search ..... 340/572.8, 572.1, 340/572.4, 572.5, 825.54, 568.1, 571; 206/460, 444, 818, 813

(56) References Cited

U.S. PATENT DOCUMENTS 5,285,191 * 2/1994 Reeb ..... 340/572.1
5,294,290 * 3/1994 Reeb ..... 156/630
5,357,240 * 10/1994 Sanford et al. ..... 340/572.8
5,867,102 * 2/1999 Souder et al. ..... 340/572.1
5,920,290 * 7/1999 McDonough et al. ..... 343/873
5,945,909 * 8/1999 Kolton ..... 340/572.1
5,988,462 * 11/1999 Kolton ..... 223/85
6,019,865 * 2/2000 Palmer et al. ..... 156/265

* cited by examiner

*Primary Examiner*—Jeffery A. Hofsass
*Assistant Examiner*—Toan Pham
(74) *Attorney, Agent, or Firm*—Robin, Blecker & Daley

(57) ABSTRACT

An article identification and surveillance tag comprises an elongate member having in longitudinal succession a top segment, a first fold portion, an intermediate segment, a second fold portion, a bottom segment, an EAS marker being secured centrally of at least one of a front surface of the intermediate segment and a front surface of said bottom segment, permanent sealable matter being disposed at marginal parts of at least one of the front surface of the intermediate segment and the front surface of said bottom segment, at least one of the rear surface of the bottom segment and the front surface of the top segment bearing a releasable sealable matter.

12 Claims, 2 Drawing Sheets

ARTICLE IDENTIFICATION AND SURVEILLANCE TAG

FIELD OF THE INVENTION

This invention relates generally to article identification and protection and pertains more particularly to tags having theft-deterrent capability.

BACKGROUND OF THE INVENTION

In commonly-assigned U.S. Pat. No. 5,945,909, which issued on Aug. 31, 1999, applicants herein disclose a so-called "seal" comprising a one-piece body having first and second members closable one upon the other and thereupon defining first and second outer seal walls and a tail peripherally continuous with at least one of the first and second members at a third seal wall and having a hook at a free end thereof. The seal body defines a detent opening into the third outer seal wall for retentive reception of the tail hook interiorly of the seal. Seals of such general type are shown in Mainetti U.S. Pat. No. 5,306,055.

In contrast to such known seals, in the seal of the '909 patent, applicants provide a seal recess and dispose an EAS (electronic article surveillance) marker in the seal recess to be secured between the first and second outer seal walls upon closure of said first and second members. The EAS marker is a flat element, produced and sold by Sensormatic Electronics Corporation. If the EAS marker is not deactivated, such as at the checkout counter of a facility, an EAS surveillance system situated at an exit of the facility detects such non-deactivation and suitably alerts facility personnel to the possibility of a fraudulent act of shoplifting occurring.

SUMMARY OF THE INVENTION

In the present invention, applicants have as their primary object to expand the technology of the '909 patent to article identification and surveillance tags.

In the attainment of this and other objects, applicants provide an article identification and surveillance tag comprising an elongate member having in longitudinal succession a top segment, a first fold portion, an intermediate segment, a second fold portion, a bottom segment, an EAS marker being secured centrally of at least one of a front surface of the intermediate segment and a front surface of said bottom segment, permanent sealable matter being disposed at marginal parts of at least one of the front surface of the intermediate segment and the front surface of said bottom segment, at least one of the rear surface of the bottom segment and the front surface of the top segment bearing a releasable sealable matter. A secured pocket is formed on folding of the bottom segment onto the intermediate segment, the EAS marker being thus contained in the pocket.

Rear surfaces of the top segment and the bottom segment have article identification imprinting thereof and, upon folding of the top segment onto the folded bottom segment, the top segment is releasably secured to the pocket containing the EAS member, i.e., to the folded rear surface of the bottom segment.

In a particularly preferred embodiment, the releasable sealable matter is transparent, thus permitting viewability of the article identification imprinting located on the rear surface of the folded bottom segment. Apertures are formed in the top, intermediate and bottom segments adjacent the first and second folded portions, whereby a flexible filament may be passed through the assembled tag to permit securement thereof to an article to be identified and protected.

Otherwise viewed, with the elongate member folded and secured, the invention provides an upstanding article identification and surveillance tag comprising, in transverse succession, a first downwardly folded segment, a releasable sealable matter, an upwardly folded segment, an EAS marker bounded by permanent sealable matter, a second downwardly folded segment, a first fold portion being connected to said first downwardly folded segment and said second downwardly folded segment and a second fold portion being connected to said second downwardly folded segment and the upwardly folded segment.

The invention will be further understood from consideration of the following description of preferred embodiments thereof and from the drawings where like reference numerals identify like parts throughout.

DETAILED DESCRIPTION OF PREFERRED EMBODIMENTS

Figure 1:
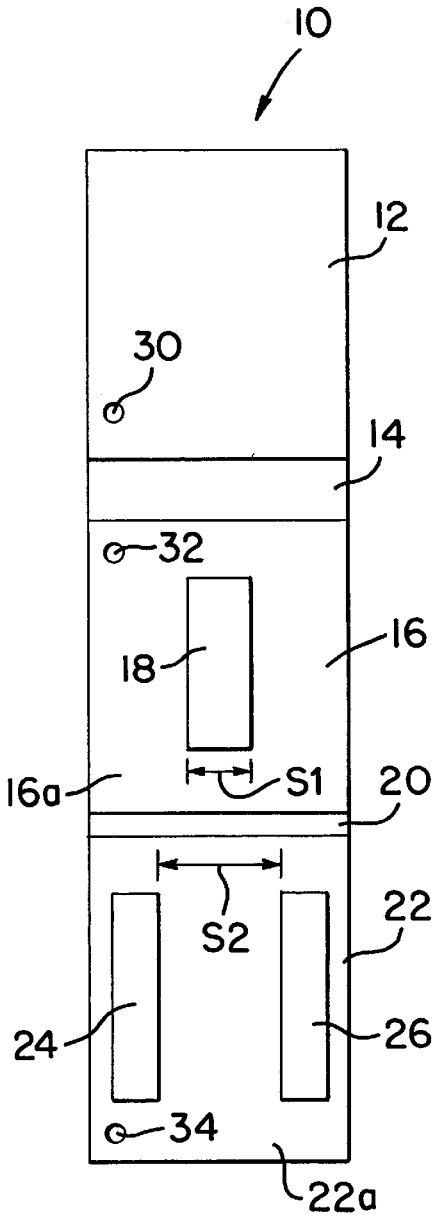
FIG. 1 is a front elevation of an article identification and surveillance tag in accordance with the invention in unfolded state.
Figure 2:
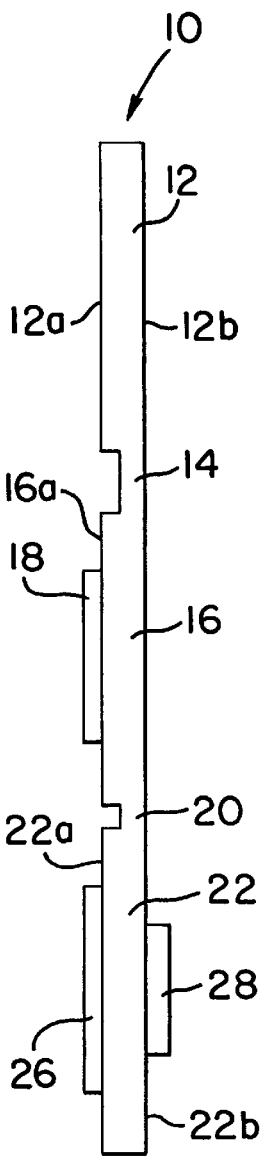
FIG. 2 is right side elevation of the tag of FIG. 1.
Figure 3:
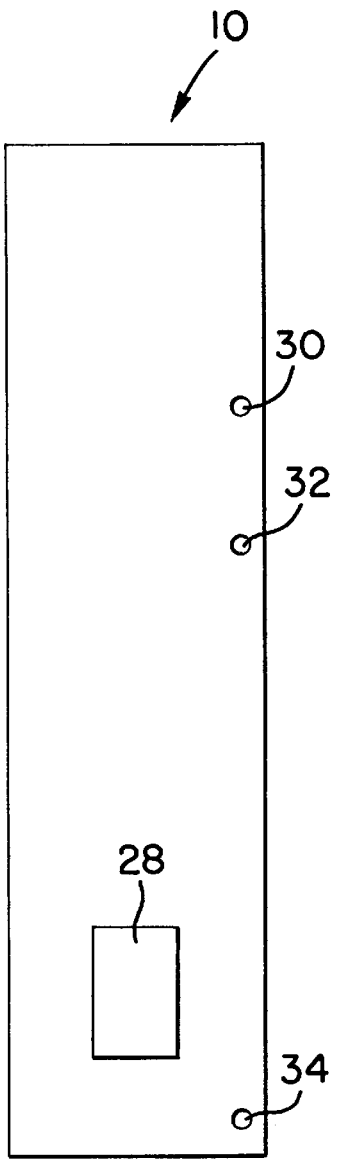
FIG. 3 is a rear elevation of the FIG. 1 tag.

Referring to FIGS. 1–3, article identification and surveillance tag 10 is comprised of an elongate member having in longitudinal succession a top segment 12, a first fold portion 14, an intermediate segment 16, upon which is centrally adhesively secured to front surface 16*a* an EAS member 18 of lateral width S1, a second fold portion 20 and a bottom segment 22, having marginal permanent adhesive strips 24 and 26 secured to front surface 22*a* thereof in transverse spacing S2, equal to or exceeding the lateral width S1. A releasable adhesive strip 28 is secured to rear surface 22*b* of bottom segment 22. The releasable adhesive strip may alternatively be applied to front surface 12*a* of top segment 12 or jointly to rear surface 22*b* of bottom segment 22 and front surface 12*a* of top segment 12.

By the terms "permanent" and "releasable" adhesive strips or matter, applicants intend to connote simply that the EAS marker-containing pocket is secured and that the securement force afforded by adhesive strip 28 between top segment 12 and folded, secured bottom segment 22 is less than the pocket securement force afforded by adhesive strips 24 and 26.

Figure 4:
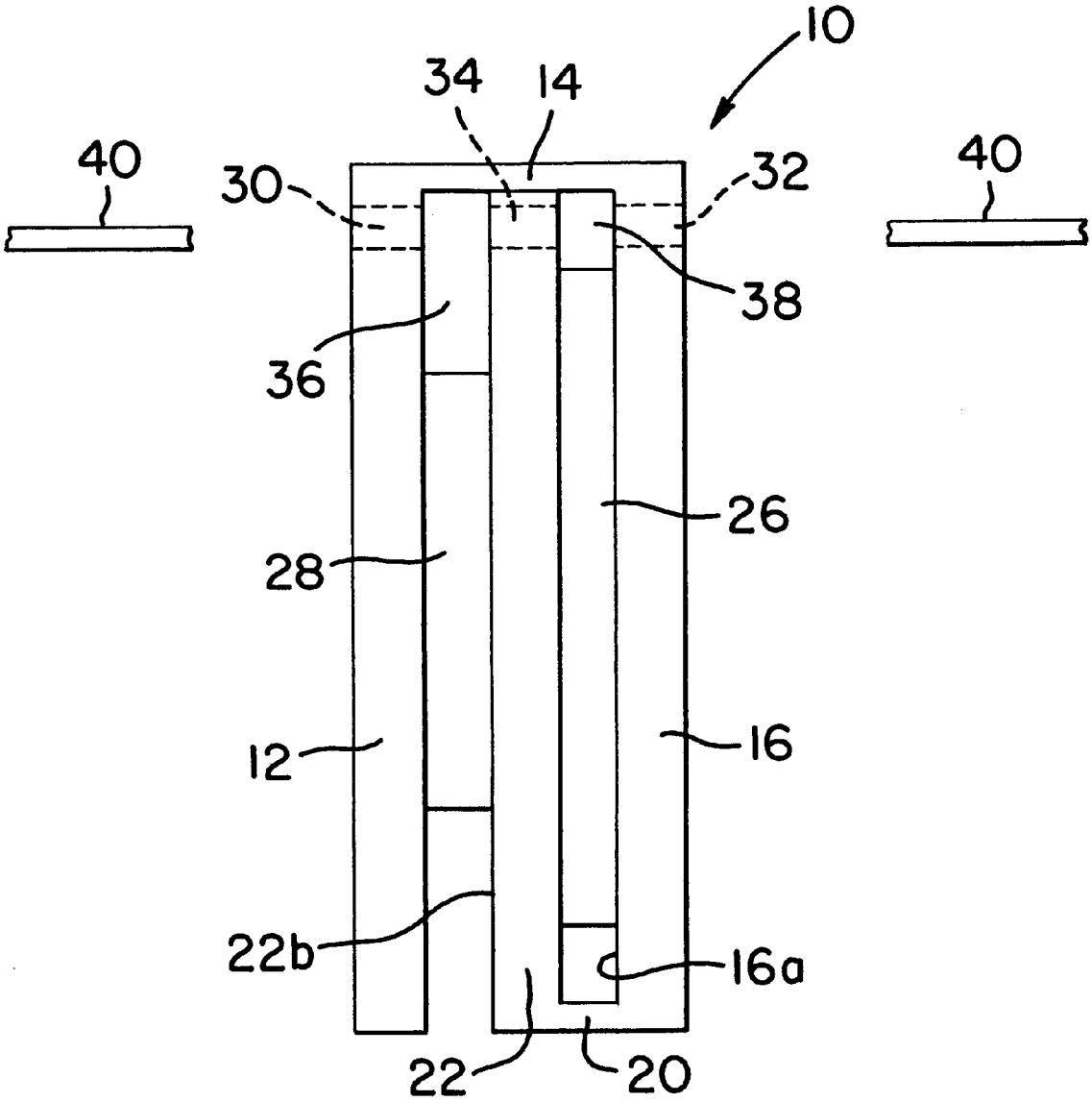
FIG. 4 is right side elevation of the FIG. 1 tag in folded condition.

Turning to FIG. 4, tag 10 is shown in fully assembled form. In reaching the FIG. 4 assembly, bottom segment 22 is folded about second fold portion 20, such that adhesive strips 24 and 26 adhere to front surface 16*a* of intermediate segment 16, aside EAS member 18 to form the aforesaid pocket. Top segment 12 is now folded onto rear surface 22*b* of bottom segment 22 through the agency of first fold portion 14 and is releasably secured thereof by adhesive strip 28.

As is shown in the drawings, openings 30 and 32 extend through top segment 12 and intermediate segment 16 adjacent first fold portion 14 and opening 34 extends through the lowermost margin of bottom segment 22 to be respectively aligned with open spaces 36 and 38 to permit the insertion of filament 40 therethrough for application of tag 10 to an article of manufacture, e.g., bridge 42 of eyeglasses.

Rear surface 22*b* of bottom segment 22 may have imprinted thereon article identification and promotional legends, as may rear surface 12*b* of top segment 12. Further, by selecting releasable adhesive strip(s) to be transparent, the legend on rear surface 22*b* of bottom segment 22 is readily readable.

Various changes to the particularly depicted embodiments of the invention may be introduced without departing from the scope of the invention. Accordingly, it is to be appreciated that the particularly disclosed embodiments are intended in an illustrative, and not in a limiting, sense. The true spirit and scope of the invention is set forth in the ensuing claims.

What is claimed is:

1. An article identification and surveillance tag comprising an elongate member having in longitudinal succession a top segment, a first fold portion, an intermediate segment, a second fold portion, a bottom segment, an EAS marker being secured centrally of at least one of a front surface of the intermediate segment and a front surface of said bottom segment, permanent sealable matter being disposed at marginal parts of at least one of the front surface of the intermediate segment and the front surface of said bottom segment, at least one of the rear surface of the bottom segment and the front surface of the top segment bearing a releasable sealable matter.

2. The article identification and surveillance tag claimed in claim 1, wherein a secured pocket containing said EAS marker is formed on folding of the bottom segment onto the intermediate segment.

3. The article identification and surveillance tag claimed in claim 2, wherein at least one of a rear surface of said top segment and the rear surface of the bottom segment bear imprinted legends.

4. The article identification and surveillance tag claimed in claim 2, wherein said releasable sealable matter is transparent.

5. The article identification and surveillance tag claimed in claim 3, wherein said releasable sealable matter is transparent.

6. The article identification and surveillance tag claimed in claim 1, wherein at least one of a rear surface of said top segment and the rear surface of the bottom segment bear imprinted legends.

7. The article identification and surveillance tag claimed in claim 6, wherein said releasable sealable matter is transparent.

8. The article identification and surveillance tag claimed in claim 1, wherein said releasable sealable matter is transparent.

9. The article identification and surveillance tag claimed in claim 1, wherein said top segment defines an aperture therethrough adjacent said first fold portion.

10. The article identification and surveillance tag claimed in claim 1, wherein said intermediate segment defines an aperture therethrough adjacent said first fold portion.

11. The article identification and surveillance tag claimed in claim 1, wherein said bottom segment defines an aperture therethrough adjacent a bottom margin of said bottom segment.

12. An upstanding article identification and surveillance tag comprising, in transverse succession, a first downwardly folded segment, a releasable sealable matter, an upwardly folded segment, an EAS marker bounded by permanent sealable matter, a second downwardly folded segment, a first fold portion being connected to said first downwardly folded segment and said second downwardly folded segment and a second fold portion being connected to said second downwardly folded segment and said upwardly folded segment.

* * * * *